US008292476B2

(12) United States Patent
Wu

(10) Patent No.: US 8,292,476 B2
(45) Date of Patent: Oct. 23, 2012

(54) LAMPSHADE

(75) Inventor: Wilson Wu, Taipei (TW)

(73) Assignee: W.K. Wu Products Inc., Taipei Hsien (TW)

( * ) Notice: Subject to any disclaimer, the term of this patent is extended or adjusted under 35 U.S.C. 154(b) by 0 days.

(21) Appl. No.: 12/191,078

(22) Filed: Aug. 13, 2008

(65) Prior Publication Data

US 2009/0225553 A1 Sep. 10, 2009

(30) Foreign Application Priority Data

Mar. 7, 2008 (TW) ..... 97203878 U

(51) Int. Cl.
*F21V 1/06* (2006.01)

(52) U.S. Cl. ..... 362/352; 362/356; 362/358; 362/806

(58) Field of Classification Search ..... 362/351–353, 362/355–358, 311.14, 311.13, 806
See application file for complete search history.

(56) References Cited

U.S. PATENT DOCUMENTS

| | | | | |
|---|---|---|---|---|
| 4,212,052 | A * | 7/1980 | Chambard | 362/352 |
| 4,275,434 | A * | 6/1981 | Borowitz | 362/352 |
| 5,532,912 | A * | 7/1996 | Bendit | 362/352 |
| 5,662,412 | A * | 9/1997 | Glendmyer | 362/351 |
| 6,561,682 | B1 * | 5/2003 | Juang | 362/352 |
| 2002/0071283 | A1 * | 6/2002 | Yu | 362/352 |

* cited by examiner

*Primary Examiner* — Jong-Suk (James) Lee
*Assistant Examiner* — Leah S Macchiarolo
(74) *Attorney, Agent, or Firm* — Muncy, Geissler, Olds & Lowe, PLLC

(57) ABSTRACT

A lampshade includes a top lampshade frame, a bottom lampshade frame, a lampshade covering covering the top lampshade frame and the bottom lampshade frame, hook materials (or loop materials) provided at the top lampshade frame and the bottom lampshade frame, and loop materials (or hook materials) provided at the lampshade covering and detachably fastened to the hook materials (or loop materials) to secure the lampshade covering to the top lampshade frame and the bottom lampshade frame.

11 Claims, 3 Drawing Sheets

LAMPSHADE

BACKGROUND OF THE INVENTION

1. Field of the Invention

The present invention relates to a lampshade for lamp and more particularly to such a lampshade, which utilizes Velcro to fasten a lampshade covering to lampshade frames.

2. Description of the Related Art

A lampshade for deck lamp generally comprises a lampshade frame and a lampshade covering. The lampshade frame comprises a top frame ring and a bottom frame ring. The top frame ring and the bottom frame ring are fastened together, forming a frame structure. Thereafter, the lampshade covering is sleeved onto the frame structure. According to this design, the frame structure of lampshade frame is not detachable. Further, the lampshade covering is not collapsible. During delivery, the frame structure and the lampshade covering require much storage space, increasing the delivery cost. A lampshade may be made by stacking lampshade elements into shape to reduce storage space during delivery. However, the shape design of the structure of lampshade is limited.

SUMMARY OF THE INVENTION

The present invention has been accomplished under the circumstances in view. According to one aspect of the present invention, the lampshade is comprised of top lampshade frame, a bottom lampshade frame, and a lampshade covering. Further, hook and loop materials are used to fasten the lampshade covering to the top lampshade frame and the bottom lampshade frame, forming the designed lampshade. When not in use, the top lampshade frame, the bottom lampshade frame and the lampshade covering are detached from one another to reduce space occupation, saving the packing and delivery cost.

According to another aspect of the present invention, the hook materials (or loop materials) are respectively provided at the top lampshade frame and the bottom lampshade frame, and the loop materials (or hook materials) are provided at the top and bottom sides of the inside wall of the lampshade covering and detachably fastened to the hook materials (or loop materials) at the top lampshade frame and the bottom lampshade frame. Therefore, it is not necessary to fasten the top lampshade frame and the bottom lampshade frame together before installation of the lampshade covering, and top and bottom lampshade frames and the lampshade covering can easily be detached from one another to reduce space occupation for delivery.

According to still another aspect of the present invention, the lampshade covering is replaceable. Because the invention utilizes hook and loop materials to fasten the lampshade covering to the top lampshade frame and the bottom lampshade frame, the user can replace the lampshade cover to provide a different design when desired.

DETAILED DESCRIPTION OF THE PREFERRED EMBODIMENT

Figure 1:
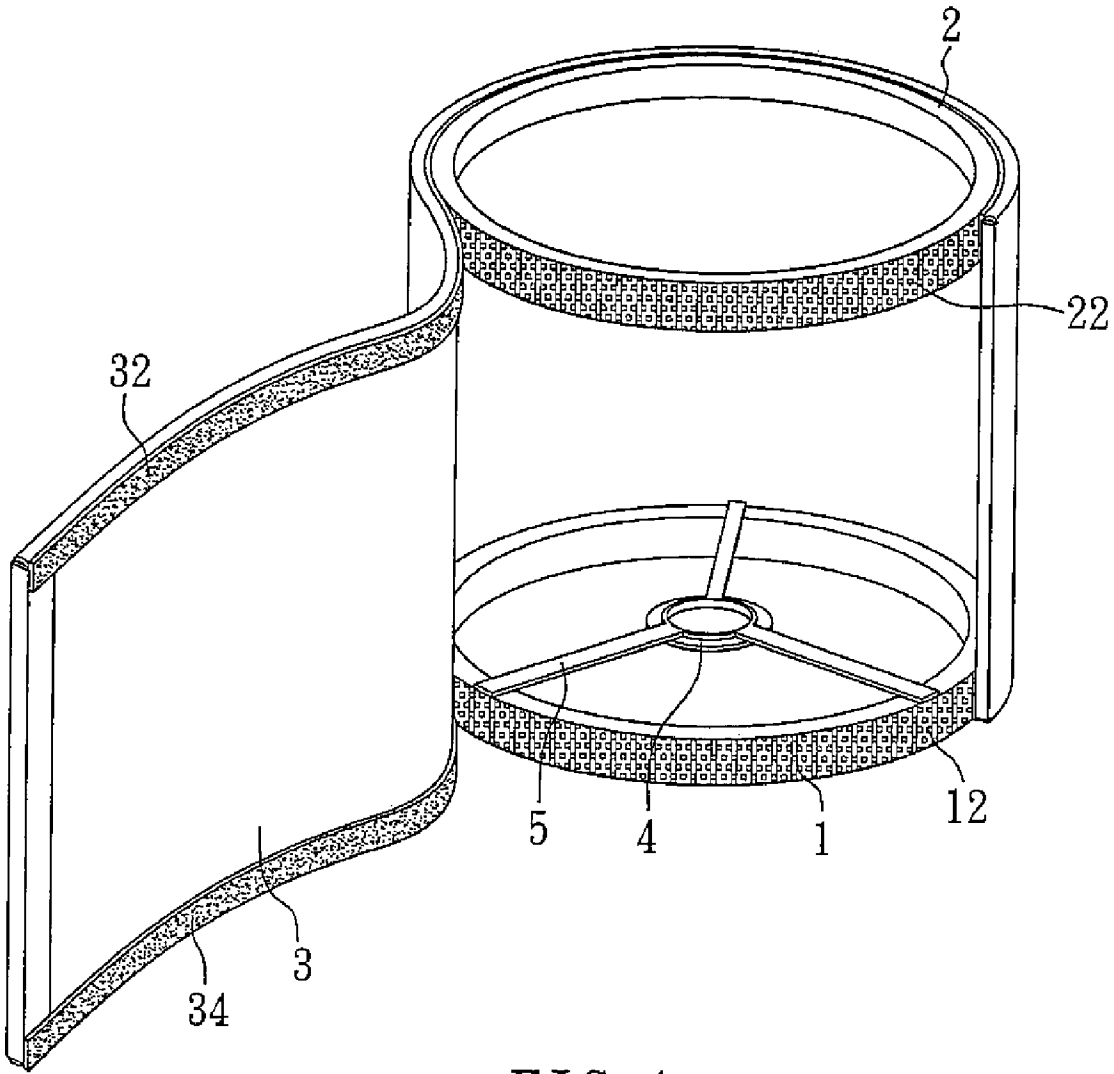
FIG. 1 is a schematic mounting view of a lampshade in accordance with a first embodiment of the present invention.

The invention utilizes Velcro to secure a lampshade covering to a lampshade frame. The Velcro includes hook materials and loop materials. The hook materials and the loop materials can be detachably fastened together. Further, the positions of the hook materials and the loop materials can be exchanged. As illustrated in FIG. 1, a lampshade in accordance with a first embodiment of the present invention is comprised of a bottom lampshade frame 1, a top lampshade frame 2, and a lampshade covering 3. The bottom lampshade frame 1 is an annular frame member. Further, a lamp holder 4 is suspending at the center of the bottom lampshade frame 1, and three radial connection rods 5 are equiangularly spaced around the lamp holder 4 and connected between the periphery of the lamp holder 4 and the inside wall of the annular bottom lampshade frame 1. The top lampshade frame 2 according to the present preferred embodiment is an annular frame member. Further, the annular bottom lampshade frame 1 and the annular top lampshade frame 2 have a respective first fastening member 12 or 22 respectively provided at the outside wall. The lampshade covering 3 has two second fastening members 32 and 34 respectively arranged on the inner surface along the top and bottom sides. By means of fastening the second fastening members 32 and 34 to the first fastening members 12 and 22 respectively, the lampshade covering 3 is fastened to the annular bottom lampshade frame 1 and the top lampshade frame 2 to surround the annular bottom lampshade frame 1 and the top lampshade frame 2. Further, the first fastening members 12 and 22 can be hook materials, and the second fastening members 32 and 34 can be loop materials. Alternatively, the first fastening members 12 and 22 can be loop materials, and the second fastening members 32 and 34 can be hook materials.

Figure 2:
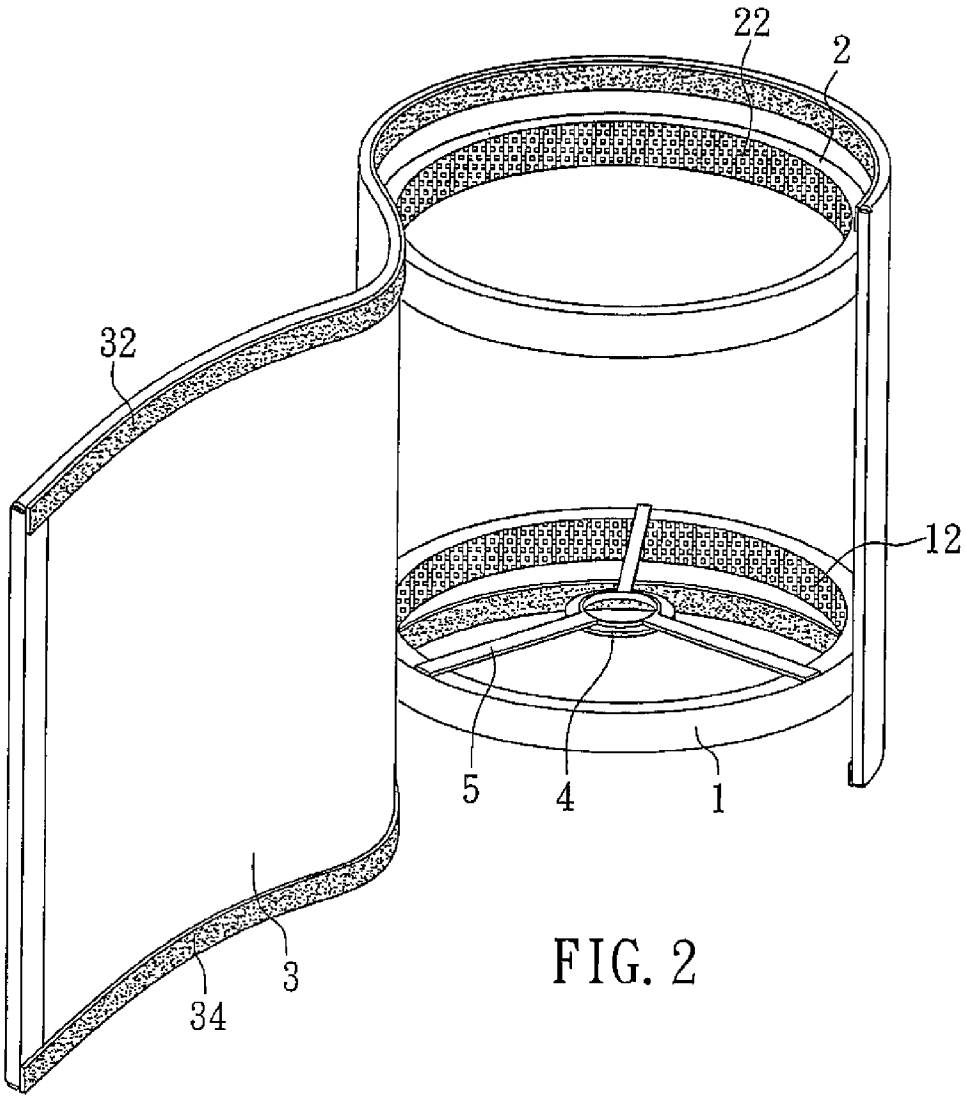
FIG. 2 is a schematic mounting view of a lampshade in accordance with a second embodiment of the present invention.

FIG. 2 shows a lampshade in accordance with a second embodiment of the present invention. This embodiment is substantially similar to the aforesaid first embodiment with the exception that the first fastening members 12 and 22 are respectively provided at the inside wall of the bottom lampshade frame 1 and the inside wall of the top lampshade frame 2, and the top and bottom edges of the lampshade covering 3 are respectively folded downwards or upwards to force the second fastening members 32 and 34 into engagement with the first fastening members 12 and 22 respectively.

Figure 3:
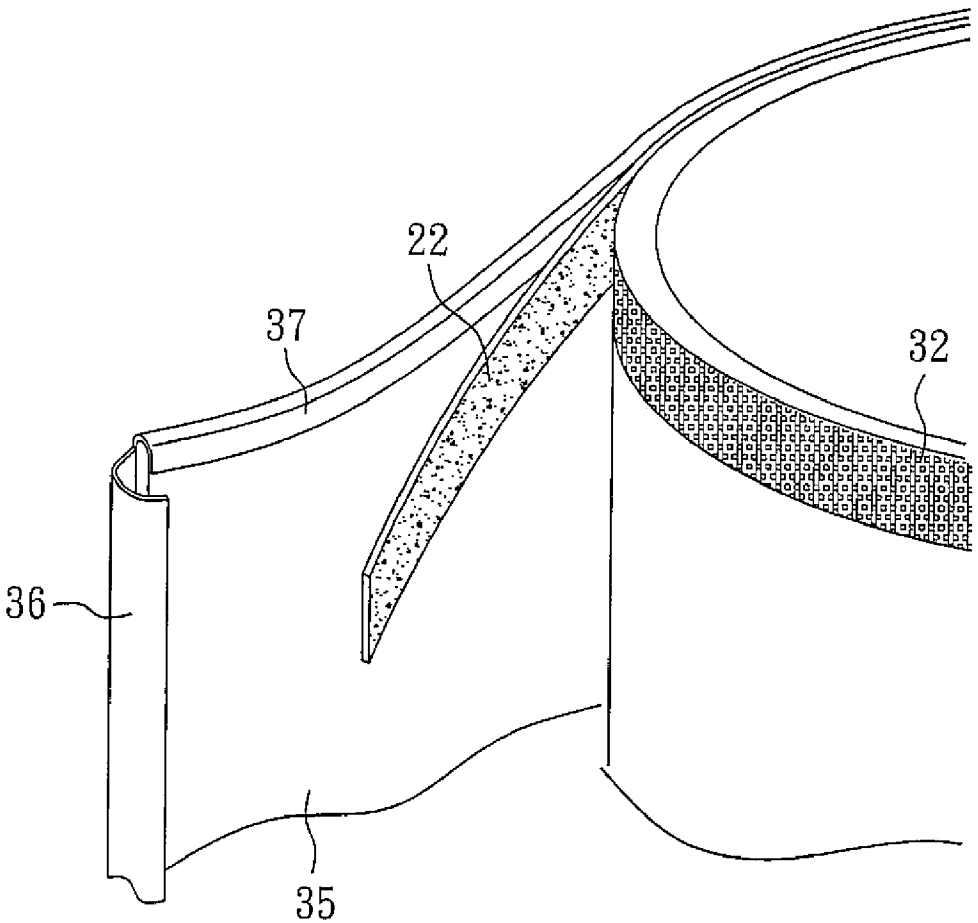
FIG. 3 is a schematic mounting view of a lampshade in accordance with a third embodiment of the present invention.

FIG. 3 shows a lampshade in accordance with a third embodiment of the present invention. According to this embodiment, the lampshade covering 3 is formed of a light transmissive film 35 and a fabric 36. The fabric 36 is covered on the outer side of the light transmissive film 35, having the top end folded down and covered on the back surface of the light transmissive film 35, forming a hem 37. The first fastening member 22 is affixed to the hem 37 for securing to the corresponding second fastening member 32 at the top lampshade frame. Further, the first fastening member 22 is affixed to the hem 37 at a distance, for example, 5 cm below the topmost edge of the hem 37.

Although particular embodiments of the invention have been described in detail for purposes of illustration, various modifications and enhancements may be made without departing from the spirit and scope of the invention.

What the invention claimed is:

1. A lampshade with detachable lampshade frames and lampshade covering comprising:

a top lampshade frame having a flat face;

a bottom lampshade frame having a flat face;

a lampshade covering covering said top lampshade frame and said bottom lampshade frame;

a plurality of first Velcro members directly mounted on and directly in contact with said top lampshade frame and said bottom lampshade frame; and a plurality of second Velcro members provided directly in contact with said lampshade covering and detachably fastened to said first Velcro members to secure said lampshade covering to said top lampshade frame and said bottom lampshade frame, such that said lampshade covering is readily detachable from and attachable to the lampshade frame, wherein the top and bottom lampshade frames each have an inner periphery and outer periphery and wherein the first Velcro members only contact and are in direct contact and directly fixed to the outer peripheries of the top and bottom lampshade frames without contacting the inner peripheries of the top and bottom lampshade frames.

2. The lampshade as claimed in claim 1, wherein said bottom lampshade frame comprises a lamp holder suspending at a center thereof, and a plurality of radial connection rods equiangularly spaced around said lamp holder and connected between an inside wall of said bottom lampshade frame and the periphery of said lamp holder.

3. The lampshade as claimed in claim 1, wherein said lampshade covering comprises a transparent film and a fabric covering a front surface of said transparent film, said fabric having top hem covered on a back surface of said transparent film; at least one said second Velcro is provided at said top hem.

4. The lampshade as claimed in claim 1, wherein the first Velcro members are in physical contact with the top lampshade frame and the bottom lampshade frame without any disruptions therebetween.

5. The lampshade as claimed in claim 4, wherein the second Velcro members are in physical contact with the lampshade covering without any disruptions therebetween.

6. The lampshade as claimed in claim 4, one of the first Velcro members surround a periphery of at least one of the top lampshade frame and the bottom lampshade frame.

7. The lampshade as claimed in claim 6, wherein the first Velcro members surround a periphery of the top and bottom lampshade frame.

8. The lampshade as claimed in claim 1, wherein the second Velcro members are in physical contact with the lampshade covering without any disruptions therebetween.

9. The lampshade as claimed in claim 1, one of the first Velcro members surround a periphery of at least one of the top lampshade frame and the bottom lampshade frame.

10. The lampshade as claimed in claim 1, wherein the first Velcro members surround a periphery of the top and bottom lampshade frame.

11. The lampshade as claimed in claim 1, wherein the first Velcro members are permanently mounted on the top lampshade frame and the bottom lampshade frame.

* * * * *